United States Patent [19]

Woolley

[11] Patent Number: 4,534,197

[45] Date of Patent: Aug. 13, 1985

[54] METHOD AND APPARATUS FOR STRAIGHTENING PIPE

[76] Inventor: Brown J. Woolley, P.O. Box 1249, Kilgore, Tex. 75662

[21] Appl. No.: 615,038

[22] Filed: May 29, 1984

Related U.S. Application Data

[63] Continuation of Ser. No. 360,940, Mar. 23, 1982, abandoned, which is a continuation of Ser. No. 79,548, Sep. 27, 1979, abandoned.

[51] Int. Cl.[3] ..... B21D 3/04

[52] U.S. Cl. ..... 72/98; 72/99

[58] Field of Search ..... 72/98, 99, 110, 95

[56] References Cited

U.S. PATENT DOCUMENTS

| | | | |
|---|---|---|---|
| 2,016,038 | 10/1935 | Hartley | 72/98 |
| 2,314,953 | 3/1943 | Siegerist | 72/98 |
| 2,757,707 | 8/1956 | Siegerist et al. | 72/98 |
| 2,838,090 | 6/1958 | Skawden et al. | 72/98 |
| 2,996,789 | 8/1961 | Pridy | 29/81 |
| 3,396,565 | 8/1968 | Miller | 72/216 |
| 3,446,054 | 5/1969 | Pridy | 72/389 |
| 3,706,215 | 12/1972 | Horton | 72/99 |
| 3,858,425 | 1/1975 | Thompson | 72/110 |
| 4,131,005 | 12/1978 | Pridy | 72/40 |
| 4,147,046 | 4/1979 | Blattler | 72/110 |

FOREIGN PATENT DOCUMENTS

| | | | |
|---|---|---|---|
| 831323 | 1/1970 | Canada | 72/98 |

*Primary Examiner*—Lowell A. Larson
*Attorney, Agent, or Firm*—Vinson & Elkins

[57] ABSTRACT

An apparatus for straightening pipe, round bars or similar elements, wherein the pipe moves between rolls which subjects the pipe to tensile and compressive stresses and forces as it rotates in the straightener apparatus, with the movement of the pipe being effected by rotation of the rolls. Certain of the rolls are vertically adjustable with respect to the pipe and others are horizontally adjustable with respect to the pipe and to each other while certain other rolls are adjustable both vertically and horizontally with respect to the pipe and to each other while the pipe is moving through the apparatus and the straightening operation is in progress, whereby the forces being applied to the pipe may be readily changed in accordance with the bends or other deformity in the pipe to assure that the required forces are applied to the proper pipe areas to accomplish effective straightening of the pipe.

13 Claims, 16 Drawing Figures

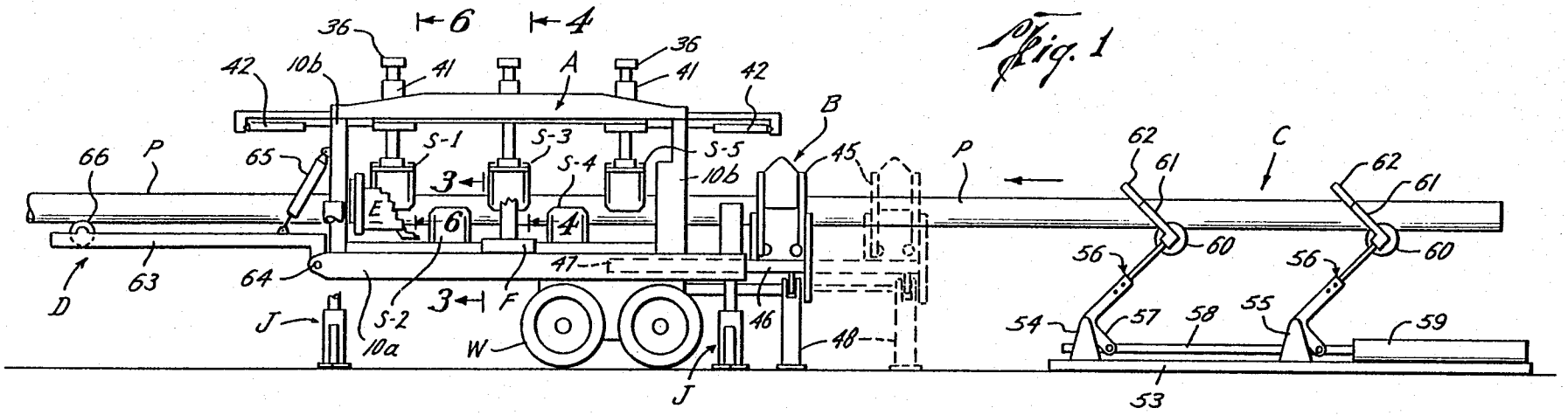
Fig. 1
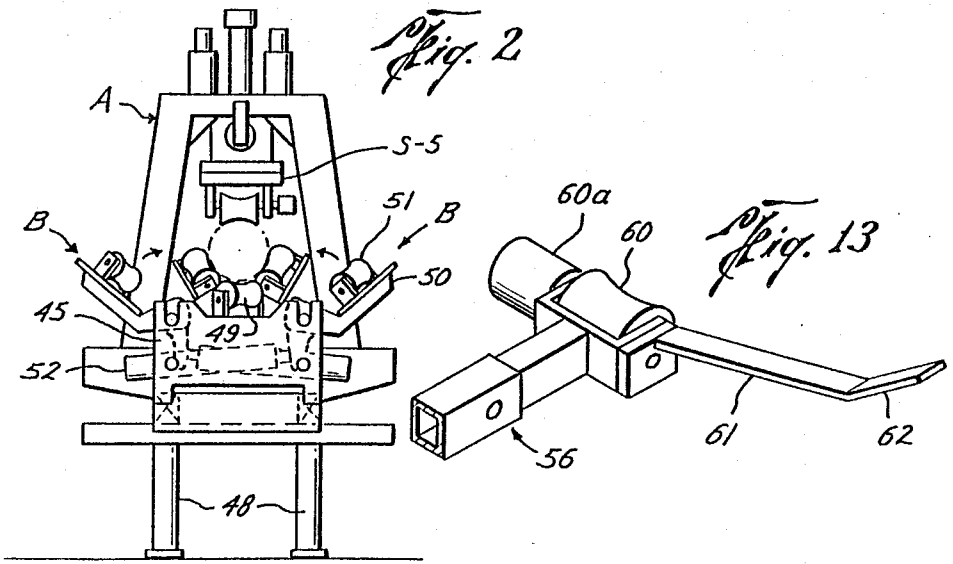
Fig. 2
Fig. 13
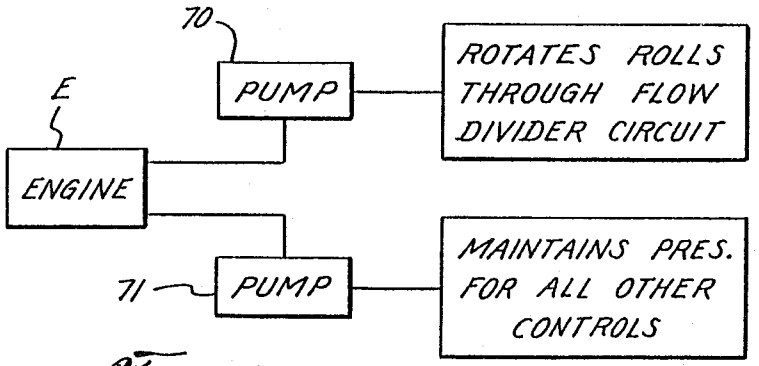
Fig. 14

10a
15a
38a
40
41
36
37
35
16
21a
26a
26c
26d
30a
32a
R
P
22

METHOD AND APPARATUS FOR STRAIGHTENING PIPE

This application is a continuation of application Ser. No. 360,940, filed Mar. 23, 1982 which is a continuation of application Ser. No. 79,548, filed Sept. 27, 1979 both abandoned.

This invention relates to new and useful improvements in methods of and means for straightening pipe or similar elements and is primarily adapted for use in straightening pipe which has been bent or deformed in service. The pipe straightening means includes rotary straightening rolls and is portable so that it can be transported to "on site" locations where the work may be performed. When the word "pipe" is used herein, it is intended to mean pipe, tubing, bars and other elongate elements which are to be straightened.

THE PRIOR ART

Various types of pipe straightener apparatus are available and in use today. One such apparatus involves the use of two or more straightening rolls which engage opposite sides of the pipe at selected points, with each roll being "skewed" or adjusted to extend at an angle relative to the axis of the pipe extending between the rolls. When the rolls are rotated, their frictional contact with the pipe imparts a rotating, as well as a longitudinal movement, to said pipe to thereby move it through the apparatus; at the same time, the rolls apply sufficient forces to the deformation of or bend in the pipe to exceed the yield point of the pipe and thereby accomplish the straightening.

Because there are particular straightness tolerances required in the manufacture of pipe, bars and similar elements, most straightening apparatus is used at the mills where there is no need for portability. Also, since the straightening is being applied to a newly manufactured pipe, bar or the like, the bends, crooks and other deformation is usually minimal. Because of this minimum deformation and also because deformation of an element being manufactured is usually about the same as other elements being produced by the same mill at the same time, the straightening rolls of a rotary straightener apparatus can be initially adjusted and set and need not undergo continuous change as each subsequent pipe or bar is fed into the apparatus. As a result, the usual roll straightener apparatus provides no means for adjusting the position of the rolls during the straightening operation.

Various types of straighteners including rotary straighteners which employ straightening rolls are described in the publication of the American Society of Metallurgy, Volume 4, 8th Edition, 1969, pages 322–331; rotary straighteners and their principle of operation appear on pages 327–328 and their applicability to straightening tubing is referred to on pages 329, 331–333.

Although the usual straightener which is employed in a mill has no need for portability, there are portable pipe straighteners now in use which are specially designed to be moved to field or other locations and are designed to straighten used pipe which has been bent or deformed in use. These straighteners provide various arrangements for applying straightening forces to the pipe but so far as applicant knows, none of them include rolls which may be readily moved to different positions, both horizontal and vertical, as a crooked pipe is passing through the straightener and while a straightening operation is being performed. As in the mill straighteners, these prior art portable straighteners allow initial adjusting and setting of their forceapplying means but do not permit horizontal adjustment to change the areas of force application to the pipe as the straightening operation is proceeding. Examples of portable type pipe straightening apparatus are illustrated in the prior U.S. Pat. Nos. 2,996,789, 3,446,054, 3,706,215, 3,396,565 and 4,131,005.

OBJECTS OF THE INVENTION

It is one object of this invention to provide an improved pipe straightener which includes upper and lower rolls for applying the necessary forces at the required areas on the pipe to straighten said pipe and which also includes means for changing the position, both vertical and horizontal, of the rolls relative to the pipe during the straightening operation, whereby the forces and stresses, as well as the pipe areas at which certain of said forces and stresses are applied to the pipe, may be varied in accordance with the bends, crooks or other pipe deformation while the pipe straightening operation is occurring to thereby accomplish effective straightening of said pipe.

A particular object is to provide a pipe straightener apparatus which is readily portable and may be used in any location or area where the bent pipe is located to thereby eliminate the expense of hauling the pipe to be straightened over long distances to a plant-type pipe straightener.

Another object is to provide a pipe straightener of the character described, wherein all straightening rolls and other associated devices are power actuated, preferably by hydraulic means, and controlled from a central control, all of said rolls being adjustable vertically and certain of the rolls being additionally adjustable horizontally while the straightening operation is in progress so that the position of any particular unit of the apparatus may be changed in accordance with the specific deformation of the pipe; this arrangement making it possible to effectively straighten pipe which has been excessively bent or deformed in use and which would otherwise have to be discarded.

A further object is to provide a pipe straightener apparatus wherein all of the straightener rolls are positively driven and are so constructed that the rolls not only apply the required forces to the pipe but also provide the motive power to move the pipe through the apparatus; said rolls being quickly adjustable to change the speed of travel of the pipe and being so mounted that they have the capability of handling a wide range of pipe sizes, as well as a wide range of wall thicknesses of the same size pipe.

Another object is to actuate and control all positions of the straightening rolls through means which is remotely located from the rolls, with the system utilizing power means whereby fast adjustment of the rolls is possible to assure effective application of forces to the proper areas of the pipe being straightened as said pipe is moving through the apparatus.

A further object is to provide a method of straightening pipe including the steps of moving a pipe between straightening rolls, applying pressure forces to areas of the pipe, which areas are selected in accordance with the deformation pattern of the pipe, and changing the position of the applied forces in accordance with changes in succeeding deformation areas of the pipe without halting the movement of the pipe as it moves between the straightening rolls to effect the straightening operation.

Other objects and advantages of the present invention are hereinafter set forth and are explained in detail with reference to the drawings wherein:

FIG. 1 is a side elevation of a pipe straightening apparatus constructed in accordance with the invention and for the sake of clarity, omitting the engine, the pumps and hydraulic lines and some of the motors and cylinders which are employed in actuating the various units of the apparatus.

FIG. 2 is an end view of the entrance end of the apparatus showing the entrance and stabilizer assembly.

FIG. 13 is an enlarged partial isometric view of the end portion of one of the lift arms of the lift assembly.

FIG. 14 is a schematic view illustrating the relationship of the engine and pumps to the various units of the apparatus.

Figure 3:
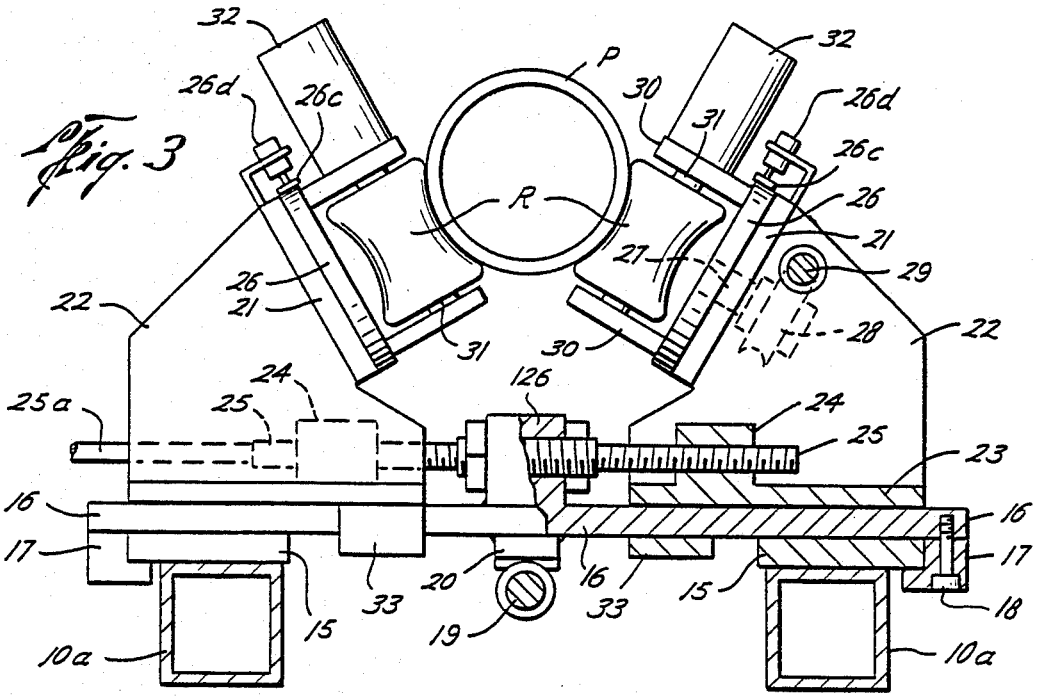
FIG. 3 is a vertical sectional view taken on the line 3—3 of FIG. 1 and illustrating one of the lower roll stands.

In the drawings (FIG. 1), the letter A designates the straightening assembly of the apparatus and includes a frame structure 10 which is supported on wheels W whereby it is readily portable.

The frame may be formed in any suitable manner and may be of any desired construction which may include I-beams or the like. However, for purposes of strength, it has been found that boxlike longitudinal beams 10*a* and vertical box-like beams 10*b* provide sufficient strength. The structural frame is, of course, reinforced and connected by whatever braces or other members may be required to give the structure the necessary rigidity and the drawings do not include all of the structural members which might be included in a particular frame structure. So long as the frame has a relatively open area so that its interior is visible to an operator, it may include any type of structural members.

A lifting jack J is disposed at each corner of the frame and is operated by a power means secured to the frame. When the jacks J are actuated, the frame is lifted to raise the wheels W off the ground and thereafter, said jacks support the assembly in a stationary position during the pipe straightening operation. A plurality of roll stands S-1, S-2, S-3, S-4 and S-5 are mounted within the frame structure 10 and are supported in each stand. As will be explained, the pipe to be straightened, designated P, is moved through the assembly A and is engaged by rolls R (FIGS. 8 and 9) of the various roll stands which rolls apply the necessary forces to the pipe at the proper areas to perform the straightening operation.

Since the frame structure 10 is relatively open, the rolls R of the roll stands are clearly visible to the operator so that the operator may make necessary adjustments in accordance with the bends and deformities in the pipe which is moving into the apparatus. The operation and adjustment of said rolls will be controlled through a control panel which is designated at F in FIG. 1. The frame structure will also carry a prime mover, such as an engine E, which is used to drive the power means, which is preferably hydraulic, to operate the various units of the apparatus.

The apparatus also includes an entrance end stabilizer assembly B which is capable of adjustment relative to the entrance end. Spaced outwardly from the stabilizer assembly B is a pipe lift assembly C which is provided for the purpose of lifting the pipe upwardly into a horizontal plane in alignment with the rolls of the roll stands of the straightening assembly. At the exit end of the assembly A, a stabilizer arm D is pivotally attached to the assembly and may be raised into a position which will stabilize the end of the pipe as it is moving out of the assembly A. The arm D also functions as a drawbar which may have its outer end attached to a tractor or towing truck when the apparatus is to be moved from place to place.

The straightening assembly A, being mounted upon wheels W, is readily portable and upon reaching the location at which a pipe straightening operation is to take place, the jacks J are lowered to engage the ground to support the assembly in a stationary position. Thereafter, a length of pipe P is moved into position to be engaged by the pipe lift assembly C so that said pipe is raised to an elevation in alignment with the rolls R of the various roll stands S-1 through S-5. The pipe moves through the entrance stabilizer assembly B and onto the rolls R of the lower pipe stands S-2 and S-4. The upper stands S-1, S-3 and S-5 are then moved downwardly to move their rolls R into contact with the pipe and are operated to move the pipe through the apparatus. At the same time, the rolls R apply the required forces to those areas of the pipe to perform the pipe straightening operation.

THE PIPE STRAIGHTENING OPERATION

Figure 8:
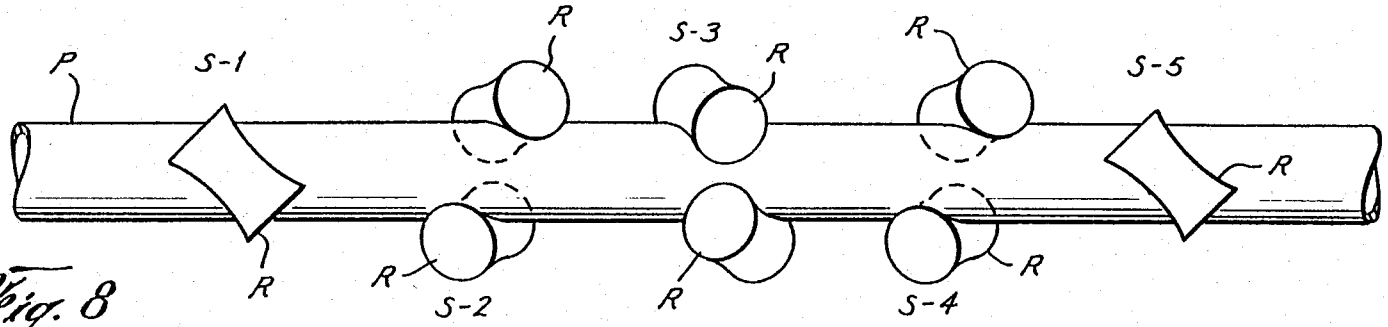
FIG. 8 is a schematic plan view of the roll arrangement.
Figure 9:
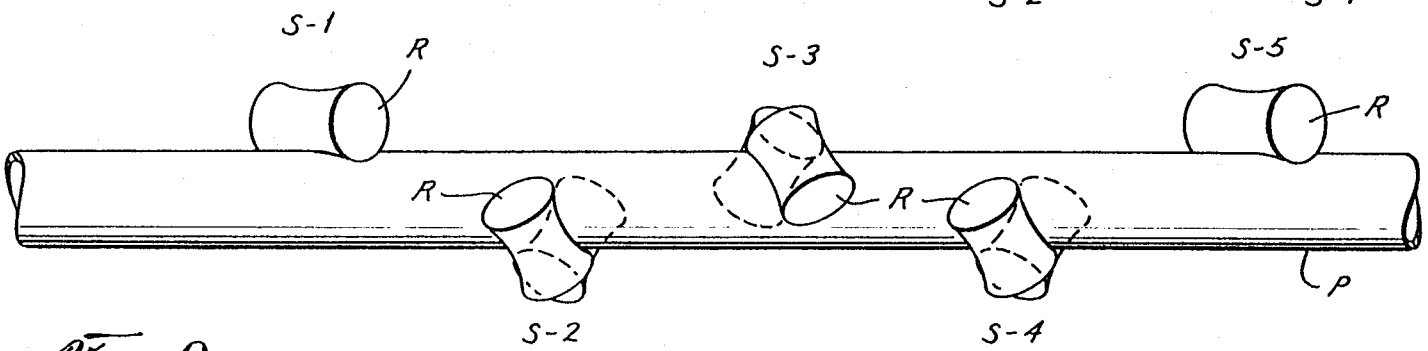
FIG. 9 is a schematic view showing the position of the rolls in side elevation.

The action of the rolls R of the roll stands S-1 through S-5 in straightening pipe is best shown in the schematic views identified as FIGS. 8 and 9; in these views and for the sake of clarity, the details of the mounting of such rolls is omitted. FIG. 8 is a plan view of the rolls R as they engage a pipe moving through the apparatus, while FIG. 9 is a side elevation of the same. It will be noted that the roll R of the roll stands S-1 and S-5 which are the upper end roll stands, is a single roll engaging the upper surface of the pipe P. As will be explained, these end rolls are adjustable vertically with respect to the pipe and are also adjustable horizontally so that they may be moved inwardly and outwardly with respect to the rolls R of the central top stand S-3.

The central top stand S-3 has dual rolls R, both engaging the upper surface of the pipe P, and these central dual rolls are adjustable only in a vertical direction. Therefore, they remain in the central upper position at all times.

The two lower roll stands S-2 and S-4 are identical in construction and each includes dual rolls R which engage the lower surface of the pipe being straightened. Since the upper rolls are adjustable vertically, downward pressure upon the pipe will be exerted by the rolls of stand S-3. Such downward pressure is resisted by the dual rolls R of the lower stands S-2 and S-4 which are on opposite sides of the upper central dual rolls relative to the longitudinal axis of the pipe. The lower or bottom roll stands S-2 and S-4, which carry the support rolls are not adjustable in a vertical direction. However, these roll stands are movable in a horizontal direction, which is in a direction longitudinally of the pipe and, therefore, their respective rolls R may be adjusted or positioned with relationship to the longitudinally stationary upper central rolls R of roll stand S-3. Adjustment makes it possible to handle pipes of different sizes and of different wall thicknesses.

In addition to adjusting for the size and the wall thickness of the pipe being straightened, all of the roll stands may be adjusted to take care of the different types of bends, crooks, and other deformities in a pipe. If there is an unusual kink or bend in a pipe it may be desirable to apply slightly more pressure with the central dual rolls of the roll stand S-3 or a better straightening operation may be accomplished by moving one or the other of the lower dual rolls of stands S-2 or S-4 to a different horizontal position. The same is true of adjusting the upper rolls R of the end roll stands S-1 and S-5 which may be moved either inwardly or outwardly to maintain proper application of forces to a particular bend or deformity in the pipe. Although the outer single rolls R of the outer roll stands S-1 and S-5 do apply downward forces to the pipe to coact with the lower rolls and thereby assist in the straightening operation, they also function to stabilize pipe movement and particularly reduce excessive wobbling of the trailing portion of the pipe as it rotates during the straightening operation.

Figure 10:
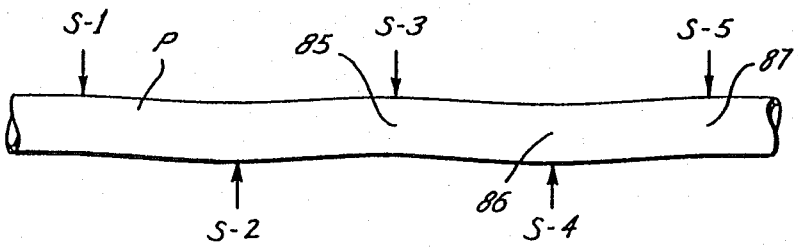
FIG. 10 is a view showing a section of an excessively deformed section of pipe.

Although FIGS. 8 and 9 illustrate a substantially straight pipe, it will be understood that the pipe will assume a substantially straight position only as it leaves the apparatus. A schematic illustration of a bent pipe prior to its entrance into the assembly A, which is more accurate of the deformity in a particular pipe is illustrated in FIG. 10.

Neither FIGS. 8 or 9, being schematic views, show the manner in which the roll stands are adjustable to position the rolls R in proper relationship to the pipe being straightened. However, the stands are all mounted to be power actuated and the arrangement is such that each of the roll stands may undergo vertical adjustment and the rolls of stands S-1, S-2, S-4 and S-5 may be adjusted horizontally while the pipe straightening operation is progressing. Thus if an excessively large bend is encountered as the pipe is moving through the apparatus, the roll stands may be varied to relocate their respective rolls R and apply the necessary forces to the proper areas of the pipe as the pipe straightening operation proceeds.

In addition to the foregoing adjustments which the various rolls of the roll stands may undergo in relationship to the pipe being straightened, each of the rolls R of each stand are constantly driven or rotated by individual power means which preferably is a hydraulic motor. Additionally, each roll may be skewed or disposed at an angle with respect to the longitudinal axis of the pipe as is clearly illustrated in FIG. 8. This skewing or angularity, with the roll undergoing rotation, will impart a rotative motion as well as a longitudinal movement to the pipe. Actually, the rolls R engaging the pipe at an angle to the longitudinal axis of the pipe impart a spiralling rotative motion which results in the longitudinal or horizontal movement of the pipe through the machine. Each roll is driven by its individual power means, is adjusted to its skewed position by its individual power means and is arranged to be locked in adjusted position.

From the foregoing, it will be seen that the apparatus provides a plurality of roll stands with the forces being applied through the rolls R of the various stands. The single rolls of stands S-1 and S-5 also function as stabilizing rolls at the outer ends of the pipe being straightened. As is well known, when there are bends or deformities in a pipe, said pipe will not rotate on a specific axis, but instead, its ends will tend to wobble or move in an eccentric manner. The rolls R of stands S-1 and S-5 being applied to the upper surface of the pipe will reduce this action to a minimum. Additionally, the wobbling action of the pipe end will be minimized by the use of the stabilizer assembly B at the entrance end of the apparatus. Since the pipe will be substantially straight as it exits from the straightening assembly A, there is little need for stabilization at such end.

Although any power means may be employed for controlling the various units of the apparatus, hydraulic means has been found satisfactory and the detailed description will refer to hydraulic devices as said power means.

THE LOWER ROLL STANDS

As has been noted, the apparatus includes two lower roll stands S-2 and S-4, each of which includes dual rolls R; the roll stands and rolls are identical and, therefore, only roll stand S-2 will be described. By using two rolls in each stand, the length of the roll may be shortened and will provide a longer life by eliminating undue abrasion. Referring to FIG. 3 which illustrates roll stand S-2 in partial cross-section, the structural members of the main frame 10 are box-like beams 10*a* extending longitudinally of the apparatus. Supported upon and secured to each of the beams, which are spaced apart in parallel relationship, is a longitudinal slideway 15 upon which each of the lower stand assemblies are slidable.

The stand assembly includes a supporting base plate 16 extending transversely across the main frame with its longitudinal end portions slidable upon the upper surface of the slideways 15. The base plate 16 is retained against upward displacement with respect to the slideways by angular retaining members 17 which are connected by bolts 18 to the underside of said base plate. The dual roll assemblies are supported upon the base plate and are connected thereto so that movement of the plate 16 as it slides on the ways 15 will move the rolls of the assembly to different longitudinal positions relative to the pipe P. The supporting base plate is moved longitudinally along the slideways by means of a pinion 19 which engages a gear rack 20 secured to the central underside of plate 16. The pinion 19 is rotated by means of a hydraulic motor (not shown) and when rotated, will cause the plate 16 and the roll assemblies mounted thereon to be moved longitudinally of the apparatus.

Each lower roll includes a generally rectangular or square support plate 21 (FIG. 3) which is connected through vertical flanges or ribs 22 with a cross slide base 23. The cross slide base rests upon the upper surface of the supporting base plate 16 and is provided with an upstanding collar 24 through which an adjusting screw 25 extends. The screw also extends through a collar 126, which is preferably made integral with the supporting base plate 16. When the screw 25 is rotated, the cross slide base is moved transversely on the upper surface of the supporting base plate which results in movement of the support plate 21 of the roll assembly in a direction transversely of the frame, thereby moving the rolls R of each assembly either toward or away from each other.

Mounted upon the surface of the support plate 21, which is inclined with respect to the vertical, is a swivel base 26. This base has a shaft 27 extending through an opening in the support plate and said shaft has a gear 28 mounted on its outer end. The gear is engaged by an adjusting screw 29 which is driven by a hydraulic motor (not shown) and upon rotation of the screw, the swivel base shaft 27 is rotated, which will rotate the swivel base 26 relative to the support plate. The swivel base has a pair of spaced support arms 30 extending therefrom and the roll R is located therebetween with the ends of its shaft 31 being rotatable within openings in the support arms. One end of the shaft 31 is connected to a hydraulic motor 32 which is mounted on one of the arms and which, upon operation, rotates the roll R to positively drive said roll when it is engaged with the pipe.

For locking the swivel base in a selected skewed position, an arcuate clamping element **26*c* which may be in the form of a brake shoe is adapted to engage the periphery of the base. The element is actuated by a hydraulic piston and cylinder 26*d*, with the latter being attached to the support plate 21**. Thus, when the clamping element is engaged, the swivel base is clamped to the support plate. In some instances, the hydraulic fluid in the system might be employed to lock the roll in position but the clamping arrangement is preferred since it is more positive.

The second roll assembly of this stand which is on the left in FIG. 3, is identical in construction to the one just described and the parts have been similarly numbered. In order to retain the cross slide base of each roll assembly against upward movement with respect to the plate 16, retainer angle members 33 are bolted to the cross slide base and have an angular portion engaging beneath the base plate 16. The screw 25, which accomplishes an adjustment of the support for each roll, is driven by a hydraulic motor (not shown) through a shaft shown at **25*a* in FIG. 3**.

In FIG. 3, each roller R has been illustrated as having its axis disposed at a right angle relative to the radius of the pipe, but it is to be understood that this position is for illustration purposes only. In actual practice, the axis of each roll R will always be at some different angular position with respect to a radial line extending from the axis of the pipe, as is clearly shown in FIGS. 8 and 9, and each roll is formed with a concave surface so as to assure contact with the convex outer surface of the pipe. When the rolls are engaged with the pipe at a particular angle, a spiral rotation and longitudinal movement is imparted to the pipe. The various roll adjustments which may be made permit one size roll to accommodate various size pipe and pipe of different wall thickness.

THE UPPER CENTRAL ROLL STAND

Figure 5:
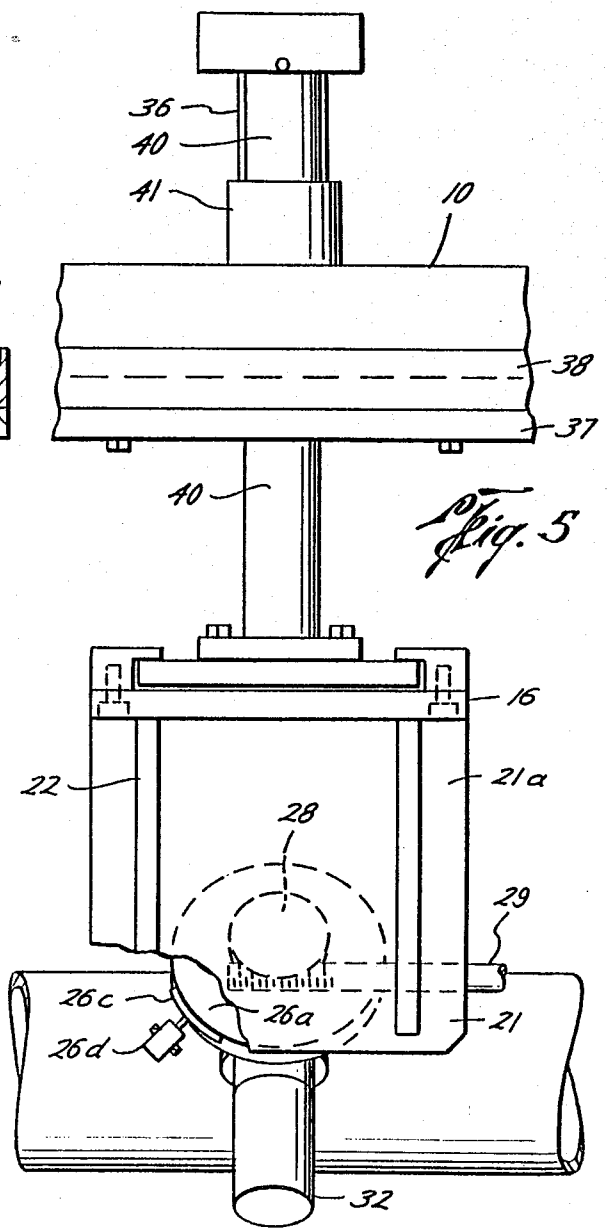
FIG. 5 is an end view of the parts illustrated in FIG. 4.
Figure 4:
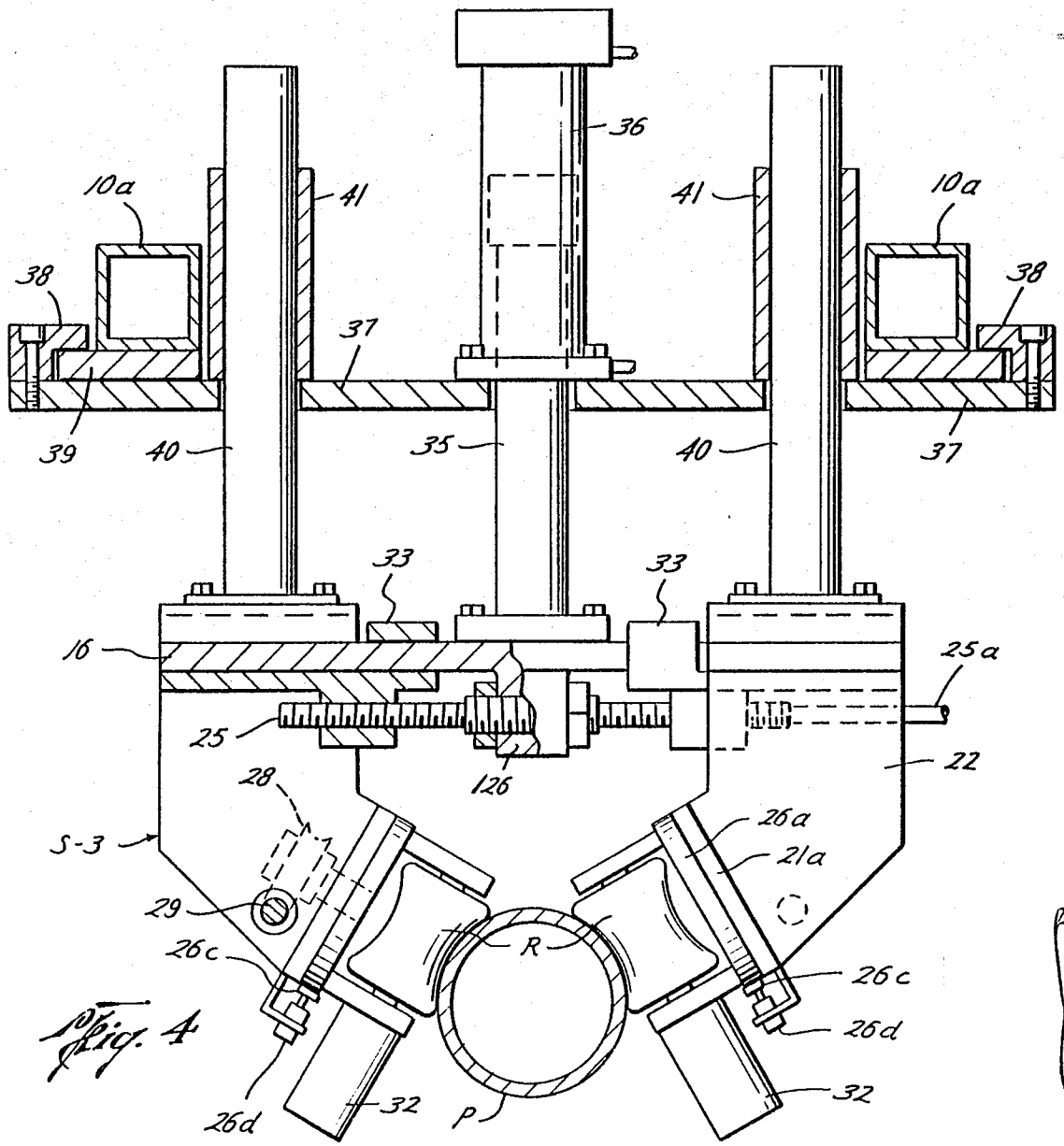
FIG. 4 is a vertical sectional view taken on the line 4—4 of FIG. 1 and illustrating the upper central roll stand.

The upper central roll stand S-3 is shown in FIGS. 4 and 5 and is substantially similar in construction to the lower roll stands S-2 and S-4, except that it operates in an inverted position and is not capable of being adjusted in a horizontal direction with respect to the pipe. Referring to FIGS. 4 and 5, the roll stand S-3 includes the dual rolls R carried by a swivel base 26 and support plate 21 of the same construction as has been described with respect to the bottom stands. The rolls R of stand S-3 are adjustable with respect to each other along a supporting base plate 16 by an adjusting screw 25 so that the distance therebetween may be varied in accordance with pipe sizes.

Instead of the base plate 16 being movable along a slideway, as is the case with the lower roll stands S-2 and S-4, the base plate of stand S-3 is attached to the lower end of a supporting piston 35. The upper end of the piston extends into a cylinder 36 which is secured to a transversely extending frame support plate 37, the longitudinal end portions of which are clamped by angular clamping members 38 to members 39 welded or otherwise secured to the underside of the longitudinally extending frame members **10*a***.

The piston and cylinder are responsive to hydraulic pressure to raise and lower the upper central rolls of the roll stand S-3 and this vertical movement is guided by vertical guide posts 40 which have their lower ends bolted to the upper surface of base plate 16 and which have their upper ends movable within guide cylinders 41 extending upwardly from the frame support member 37. With this mounting, the rolls R of the upper central roll stand may be adjusted vertically with respect to the pipe and can be skewed or angled with respect to the pipe with substantially the same type of structure as has been described in connection with the lower dual rolls of the roll stand S-21. Each of the rolls of the upper central roll stand are driven by its individual hydraulic motor 32.

It is evident that the upper central roll stand is of substantially the same construction, insofar as the rolls are concerned, as the dual rolls in the stands S-2 and S-4; the main difference is that the rolls of the upper stand S-3 may be moved only in a vertical direction, whereas the lower roll stands are movable in a horizontal direction longitudinally of the pipe. Through the use of the hydraulic piston 36, the desired pressure may be applied to the pipe surface by the rolls R of the upper central pipe stand S-3. Such pressure forces are transmitted through the pipe to the lower dual rolls of the stands S-2 and S-4, and since the latter may be adjusted longitudinally, the particular forces and areas of pressure application which is required in accordance with the deformation of the pipe may be applied. As is the case with the rolls of the lower stands S-2 and S-4, the rolls of the upper central roll stand may be vertically adjusted during a straightening operation to change the applied force. Such adjustments and changes are primarily dictated by the bends and deformities in the pipe.

THE UPPER END ROLL STANDS

Figures 6, 7:
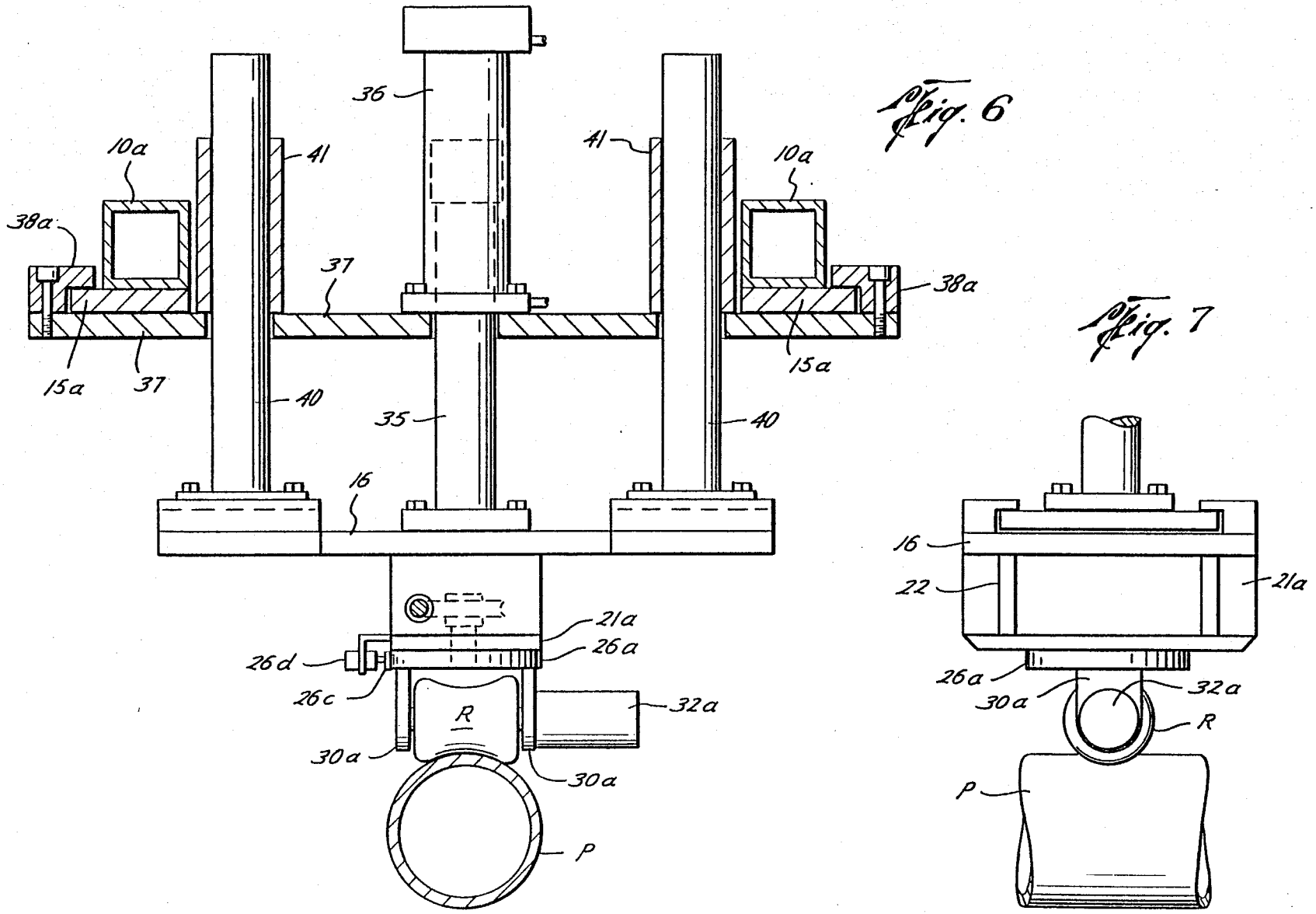
FIG. 6 is a view taken on the line 6—6 of FIG. 1 showing one of the upper single roll stands.
FIG. 7 is an end view of the parts shown in FIG. 6.

Positioned at each end area of the main frame structure 10 are the two roll stands S-1 and S-5, each of which carry only a single roll adapted to engage the upper surface of the pipe P. The structure of each end roll is shown in FIGS. 6 and 7 and the roll is mounted for vertical movement in substantially the same manner as the upper central roll stand. However, since the roll stands S-1 and S-5 are also movable horizontally, the mounting includes a transverse support plate 37, which extends between upper frame beams 10*a*, and is suspended therefrom by angle retainers 38*a* which have their horizontal portions overhanging slideways 15*a*. The slideways are secured to the underside of the frame members 10*a* by welding, bolting or other means. With this arrangement, the plate 35 may slide horizontally so that its position relative to the pipe in a longitudinal direction may be adjusted.

The roll of each end roll is moved vertically by a cylinder and guide assembly 35, 36 similar to that used with the upper central stand S-3. This assembly includes a base plate 16 which has a piston 35 movable within a cylinder 36. The base plate is also attached to the lower end of guides 40 which move within guide cylinders 41. The specific structure of the single roll carrier is substantially similar to the other roll carriers and as shown in FIG. 6, a swivel base 26*a* is provided with supporting arms 30*a*, between which the roll R of the end roll S-1 is mounted. A hydraulic motor 32*a* drives the shaft of the roll R. The swivel base 26*a* is provided with a shaft which extends through a support plate 21*a* and the angularity of the roll R with respect to the longitudinal axis of the pipe is adjusted through the same type of hydraulically activated gear and screw combination as the other rolls.

With the type of mounting shown in FIGS. 6 and 7, the single roll of the end roll stand S-1 is adjustable vertically to change the force which it applies to the outer surface of the pipe; the roll is also movable horizontally by reason of the supporting plate 37 being slidable along the ways 15*a* so permit it to be adjusted horizontally with relation to the pipe being straightened. As all other rolls, the roll R of this assembly can be skewed or angled in desired positions with respect to the pipe.

Longitudinal movement of the single roll stand S-1 is controlled by a hydraulic cylinder and piston 42 which is clearly shown in FIG. 1. Because the roll stand S-1 includes only a single roll, there is no need to provide for a cross slide, such as is employed in the three dual roll stands S-2, S-3 and S-4.

The opposite end roll S-5 is identical in construction to the roll stand S-1 and is capable of the same adjustments. Because these stands are identical, the same numerals have been applied to each and it is not deemed necessary to repeat a detailed description of the stand S-5.

THE ENTRANCE END STABILIZER ASSEMBLY

In order to assist in feeding the pipe smoothly into the apparatus and to stabilize and restrict excessive wobbling of the deformed pipe entering said apparatus, the stabilizer assembly B which is shown in FIGS. 1 and 2 is provided. This assembly includes a frame 45 which is mounted upon a horizontal piston 46 movable within a cylinder 47 secured to the main frame structure 10 (FIG. 1). The piston and cylinder are disposed horizontally so that the stabilizer may be moved varying distances from the entrance end in an aligned horizontal direction. In FIG. 1, a second position of the stabilizer assembly with respect to the main straightening assembly A is shown in dotted lines.

When the stabilizer is placed into use, a pair of supporting legs 48 are swung downwardly into the position illustrated in FIG. 2, with such action being controlled by a hydraulic cylinder (not shown). The stabilizer has a single lower roll 49 upon which the pipe being introduced into the apparatus is supported. After the initial portion of the pipe passes through the stabilizer frame, a pair of pivoted arms 50 carrying upper contact rolls 51 are swung inwardly by an actuating cylinder 52 and said rolls engage the outer surface of the pipe. The three rolls of the stabilizer continue to engage the pipe until its entire length has passed into and through the straightening assembly A. Thereafter, the cylinder 52 is operated to swing the arms 50 outwardly which moves the rolls 51 to their outward position whereby the next pipe may be directed into the apparatus.

When the apparatus is to be transported, the supporting legs 48 are swung upwardly and the stabilizer assembly is moved inwardly to the full line position of FIG. 1. This movement is accomplished by retracting the piston 46 into its cylinder 47 which locates the stabilizer assembly adjacent the end of the straightening assembly A where it does not interfere with the portability of the apparatus.

OUTBOARD PIPE LIFT

Usually the pipe to be straightened is stacked on the ground which places the pipe lengths at an elevation below the horizontal position of the roll stands and the rolls of the apparatus. For lifting the pipe lengths to the desired height, the pipe lift assembly C is provided. Although it may take various forms, the particular lifting apparatus which is shown includes a base 53 upon which are mounted two pairs of upstanding brackets 54 and 55. A lifting arm 56 is mounted between the brackets 54 and is pivoted thereto; the arm is in the general form of a bell crank lever and has a short angular extension 57 which connects to a piston rod 58 operating within a hydraulic cylinder 59. The upper end of the arm 56 has a grooved roller 60 upon which the pipe P may rest. Adjacent the roller is a pickup member 61 which is secured to the side of the pulley and which has a lateral hook 62 extending outwardly in a horizontal plane from the roller. When the arm 56 is in a lowered position, the lateral hook 62 will first engage the pipe and cause it to roll onto the rollers 60. A similar arm 56, roller 60 and pickup member 61 are pivotally mounted in the brackets 55 and also have connection with the piston rod.

When the hydraulic piston within the cylinder 59 is moved in one direction, the rollers 60 of the crank arms will move downwardly and will locate the hooks 62 in a position to receive a pipe. Upon movement of the piston in an opposite direction, the crank arm will be raised to the position shown in FIG. 1 and the pipe will be rolled onto and thereafter supported by the rollers 60. The position of the lift assembly C with respect to the stabilizer assembly B is dependent upon the length of pipe which is being handled and obviously, can be located any distance from said stabilizer and the straightening assembly A. One of the rollers 60 may be driven by a hydraulic motor 60*a* (FIG. 13) in order to move the pipe into the entrance end stabilizer and assembly A.

EXIT END STABILIZER UNIT

For stabilizing the pipe as it leaves the apparatus following the straightening operation, the exit end stabilizer unit D is mounted on the frame of the straightening assembly A. This unit includes an elongate beam 63 which is pivoted at 64 to the ends of the frame members 10*a*. The beam 63 is adapted to be raised to the position shown in FIG. 1 by piston and cylinder 65 which is hydraulically actuated. At the outer portion of the beam, a support roller 66 is mounted and as is evident from FIG. 1, the roller functions to guide and stabilize the pipe as it leaves the apparatus.

The beam 63 is sufficiently strong to function as a draw bar and its outer end may be provided with the desired connections so that a towing vehicle may be connected thereto.

HYDRAULIC CONTROL SYSTEM

Figure 15:
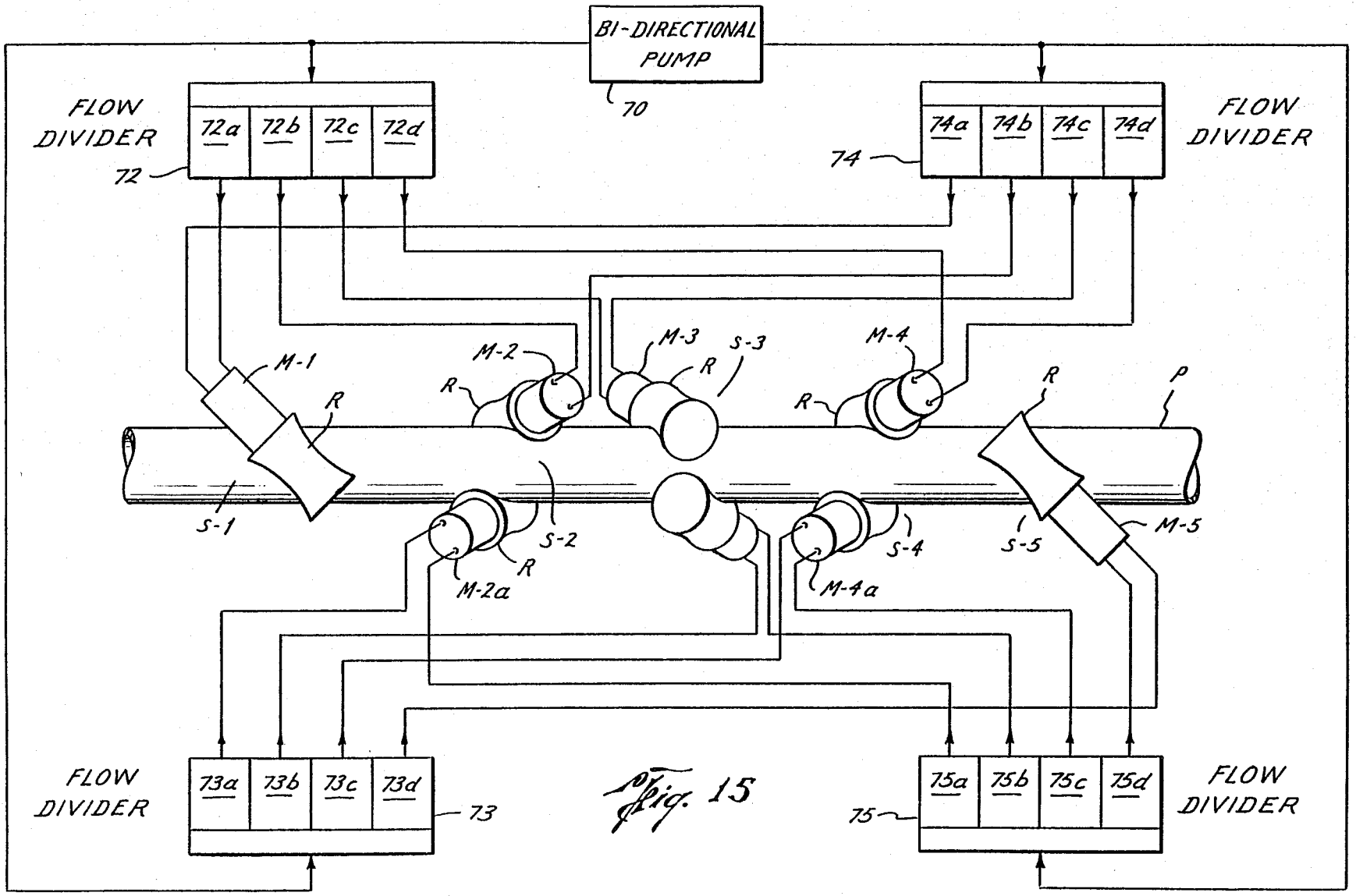
FIG. 15 is a schematic diagram of the hydraulic system which is used for driving the individual motors of the rolls.
Figure 16:
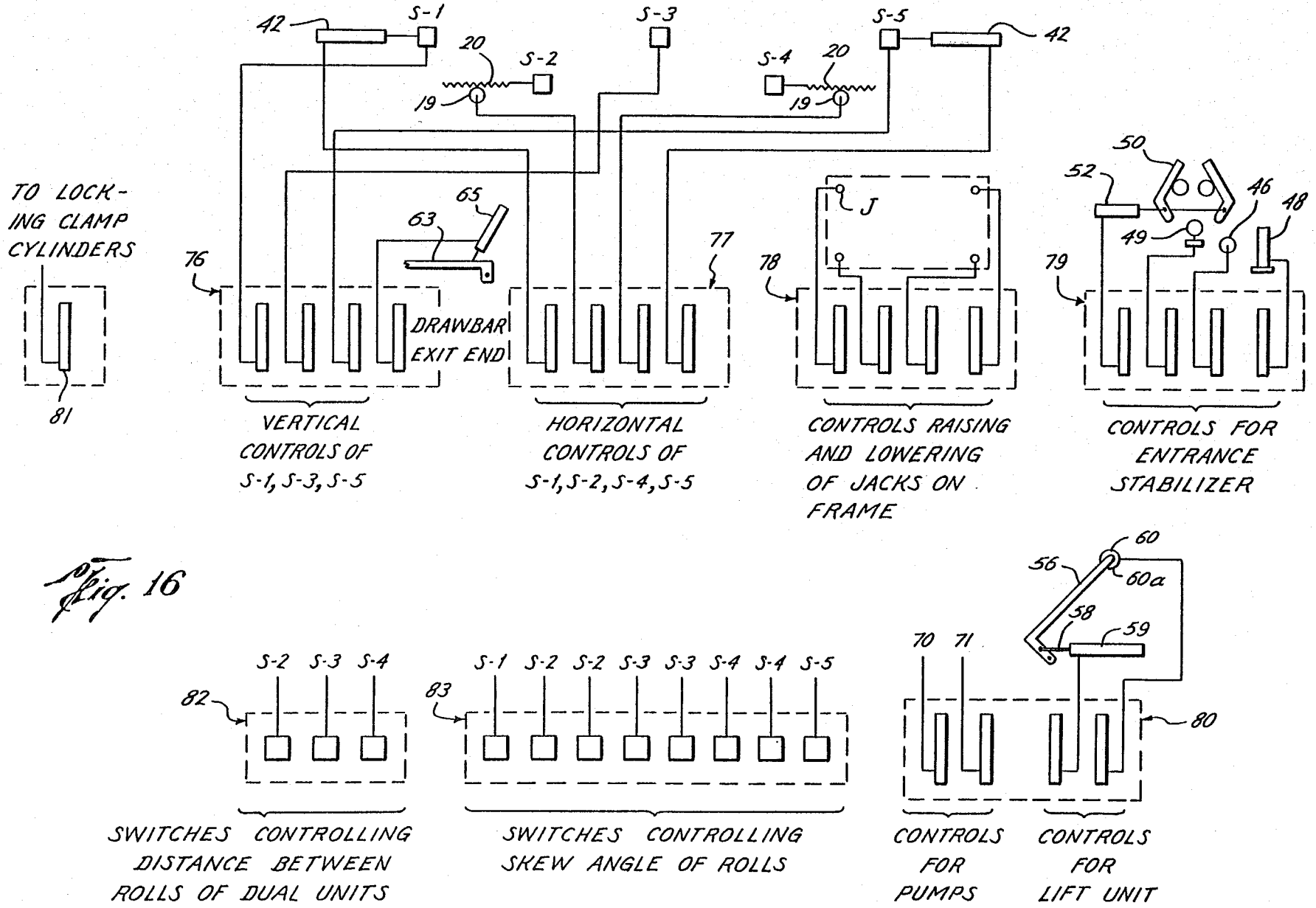
FIG. 16 is a diagram of the control system whereby all operable units of the apparatus are controlled from a single panel.

The overall hydraulic control system is diagrammatically illustrated in FIGS. 14, 15 and 16, with FIG. 14 being a block diagram showing the relationship of the engine E to the units which will be controlled. As shown in FIG. 14, the engine E, which is mounted on the frame structure of the straightening assembly A, drives pumps 70 and 71. The pump 70 supplies hydraulic fluid through the flow divider circuit, shown in FIG. 15, to all of the rolls of the various roll stands. The pump 70 is an overcenter variable volume pump which is capable of pumping in either direction and as will be explained in connection with the flow divider circuit, this pump will rotate the motors of the various rolls in one direction or the other. A suitable control lever is included in the control panel F and is movable from neutral to variable speed, to forward or to reverse positions.

The circuit which actuates the motors of the several rolls is illustrated in FIG. 15. The bi-directional pump 70 directs the flow to either a pair of flow dividers 72 and 73 or if flow is in the opposite direction, to flow dividers 74 and 75. Assuming the flow is to be the dividers 72 and 73, each of these dividers will separate said flow into four areas which have been designated with respect to the divider 72 by the letters 72*a*, 72*b*, 72*c* and 72*d*; with respect to the flow divider 73, the four areas are designated 73*a*, 73*b*, 73*c* and 73*d*. As previously explained, each roll R of the roll stands S-1 through S-5 are driven by individual motors and such motors have been designated as M-1 for the single roll for the stand S-1, M-2 and M-2*a* for the motors operating the rolls in stand S-2, M-3 and M-3*a* for the motors operating the rolls in stand S-3, M-4 and M-4*a* for the motors operating the rolls in roll stand S-4 and M-5 for the motor driving the roll R of stand S-5.

In order to assure proper operation of the motors, the flow divider areas of the divider 72 is connected to certain rolls while the areas of the divider 73 are directed to other rolls. The manner of connection of the dividers to the motors is such that the output of at least one section of each divider is loaded at all times. If one of the dividers has all of its sections or areas unloaded, there would be a free by-pass of fluid and the power in the system would be affected. Referring specifically to the connections, the area or section 72*c* has connection with motor M-1*a* while area 72*b* has connection to the roller M-2. Section 72*c* of the divider is connected to the motor M-3 of the roll stand S-3 while the fourth area 72*d* has connection with the motor M-4 of the stand S-4. Therefore, two of the areas or sections of the flow divider are connected with motors driving two of the upper rolls while the other two areas connect to rolls which engage the underside of the pipe P.

The flow divider 73 has its sections similarly connected with section 73*a* connecting with motor M-2*a*, the section 73*b* communicating and driving the motor M-3*a*, section 73*c* communicating with the motor M-4*a* and the fourth section 73*d* driving motor M-5. Again, it will be noted that two of the sections of the flow divider drive the motors of two upper rolls while the other two sections drive the motors of the two lower rolls. In this way, at least one section of each divider is loaded at all times and the system keeps any unloaded motor from affecting those motors which are loaded.

When the operation of the pump 70 is actuated to direct the flow to the flow dividers 74 and 75, the connections are such that motors are rotated in an opposite direction. The sections 74*a*, 74*b*, 74*c* and 74*d* of flow divider 74 connect to the same motors which were previously connected with the areas of the flow divider 72 so that at least two of the rolls are upper rolls while the other two are lower rolls. Similarly, the areas 75*a*, 75*b*, 75*c* and 75*d* of the flow divider 75 are connected to the same motors which have connection with the sections of the flow divider 73. Thus, when the pump is directing the fluid through the flow dividers 74 and 75, at least one section of each divider is loaded at all times whereby efficient operation of the motors is assured.

The second pump 71 of the apparatus is the pressure control pump and maintains a certain pressure throughout the hydraulic system whereby the various pistons, motors and other elements may be actuated as desired. In FIG. 16, a schematic layout of the control panel F which provides a central control station is schematically illustrated. Referring to FIG. 16, the control levers are shown in banks of four and such banks are designated by the numerals 76, 77, 78, 79 and 80. Each bank contains four control levers and notations have been made on FIG. 16 to indicate the particular function of the various control levers. Three of the control levers in the bank 76 are connected to the pistons which control the vertical movements of roll stands S-1, S-3 and S-5. The fourth lever in this bank control the piston cylinder arrangement which lifts the beam 63 at the exit end of the apparatus.

The bank 77 of control levers controls the horizontal motion which is imparted to the roll stands S-1, S-2, S-4 and S-5. Two of the levers connect with the piston cylinders 42 of roll stands S-1 and S-5 while the other two control the rotation of the pinion 19 which engages the gear rack 20 of the lower roll stands S-2 and S-4.

Bank 78 of control levers operate the jacks J of the straightening assembly A. These are the jacks which lift the unit upwardly to disengage the wheels from the ground and function to support the straightening assembly A in a stationary position.

The panel 79 of levers is provided to control the various elements of the stabilizer B at the entrance end of the unit. One of the control levers controls operation of cylinder and piston 52 which opens and closes the arms 50 carrying the upper rollers 51. One of the levers controls the raising and lowering of the bottom roller 49 of this assembly while the third lever controls operation of the horizontal piston and cylinder assembly 46, 47 which moves the stabilizer assembly B with respect to the entrance end of the straightening assembly. The fourth control lever controls the piston and cylinder which swings the supporting legs 48 into and out of supporting position.

The bank 80 of levers is divided with one pair controlling the operation of the pumps 70 and 71. The other two control levers of this bank are associated with the lifting unit C with one of the levers controlling operation of the piston and the cylinder 58, 59 and the other controlling the operation of a hydraulic motor 60*a* which drives one of the support rollers 60 of the lift unit.

A single control lever is provided for the purpose of actuating the clamping or locking elements which clamp the rolls in their skewed or angled positions. It is noted that these clamping elements are all actuated simultaneously to either lock or unlock the swivel bases of the various roll stands. Of course, if desired, a separate control for each clamp could be provided.

All of the control levers are disposed on a single central panel in the space shown at F on the side of the straightening assembly in FIG. 1. Therefore, one operator can stand beside the apparatus and because the apparatus is constructed of an open framework, all rolls and other mechanism are clearly visible to such operator. Also, the use of the single rolls S-1 and S-5 make the pipe being straightened more visible to the operator. With the control levers readily accessible, it is evident that a very accurate control of the pipe straightening operation can be carried out.

In addition to the various banks of control levers above described, the control panel is provided with a plurality of switches. A bank 81 of three switches controls the adjustment of the spacing between the two rolls R in the three dual roll stands S-2, S-3 and S-4. The control is accomplished by providing solenoid operated valves in the hydraulic system of the hydraulic motor actuating the shaft 25*a* in the lower roll stands shown in FIG. 3. When the switch is thrown, the valve directs the hydraulic pressure to the motor to rotate shaft 25 which in turn rotates the adjusting screw, thereby adjusting the position between the rolls R. Similar solenoid operated valves are controlled by switches connected with the roll stands S-3 and S-4.

The switches and solenoid operated valves are also employed for controlling the skew or the angle of each of the various rolls mounted within the roll stands. Since there are eight separate motors driving the adjusting screw 29 of each roll stand to control the angle of each roll, eight switches are employed in a second bank 82. As noted, all of the controls which are illustrated in FIG. 16 are mounted in the one central control panel F which is preferably located at the side of the main frame structure of the straightening assembly. With the open framework of the straightening apparatus, all operating parts are clearly visible to the operator and one operator can effectively control the straightening of the pipe as it moves through the apparatus.

Although the particular controls in the form of control levers and switches with solenoid operated valves have been found satisfactory, it is evident that other types of control mechanism could be used. Also, although it is desirable from a simplicity standpoint that the various units be hydraulically actuated, this is not absolutely necessary since other types of motive power can be employed.

SUMMARY OF OPERATION

In operation, the apparatus is towed to the location where the pipe straightening operation is to be performed and the parts are placed in the position shown in FIG. 1. In this position, the straightening assembly A has been lifted upwardly and is supported on its jacks J, with the wheels off of the ground. The stabilizer assembly B at the entrance end is then adjusted with respect to the end of the apparatus A and its support legs 48 are moved downwardly. The lifting unit C is spaced from the stabilizer assembly B in accordance with the length of pipe which is to be straightened.

After the apparatus has been set up, as shown in FIG. 1, the pipe is lifted into position by the lifting assembly C and the motor 60*a* rotates the roller 60 of one of the lifter arms of the lift assembly to move the pipe into the entrance end stabilizer assembly B and then into the straightening assembly A. At the appropriate time, the arms 50 of the stabilizer unit B are swung inwardly to engage its rollers 51 with the surface of the pipe. The skew or angle of the rollers in the stabilizer assembly B are manually adjusted and clamped to assist in imparting a rotation and a longitudinal movement to the pipe as it moves through the apparatus.

The roll stands S-1 through S-5 are adjusted in accordance with the particular bends or deformity in the pipe and in FIG. 10, one type of bent or deformed pipe is schematically illustrated. Referring to this Figure, the pipe P is shown to have a rather severe bend at the area marked 85 and has a bend in the opposite direction at 86, followed by a third bend at 87. In this case, the roll stands S-2 and S-4 would be adjusted horizontally with respect to the upper central roll stand S-3, the latter being stationary and applying a downward force to the pipe. Also, both of the end rolls S-1 and S-5, which engage the upper surface of the pipe may be adjusted both in vertical and longitudinal directions.

Through the control levers and switches shown in FIG. 16, the rolls of all stands except stand S-3 can be shifted and changed horizontally as the pipe moves through the apparatus A. This change of position of the rolls can be accomplished without stopping the pipe straightening operation. Also, if the particular bend is difficult to remove and it is desired to rework a particular area of the pipe, it is only necessary to reverse the flow of fluid through the pump 70, which will reverse the rotation of the rolls and move the pipe in an opposite direction. The speed of rotation of the rolls will be dependent upon the adjustment of pump operation or could be changed by increasing or decreasing the speed of the engine. However, it has been found more practical to control the rotative speed by the pump, rather than with the engine.

The various adjustments which can be made, both in the roll stands, as well as in the rolls themselves, make it possible to work on any type of pipe. As has been described in connection with the dual roll stands, the bottom rolls are capable of movement longitudinally of the pipe, with both rolls moving as a unit. Also, the skew angle of each roll is individually adjustable and each roll has its own individual motor controlling its rotation. The apparatus is capable of handling different size pipe because the dual rolls may be accurately adjusted with respect to each other by reason of the adjusting screw 25 which moves the rolls toward or away from each other. This adjustment also will accommodate pipe of different wall thicknesses and gives the apparatus the capability of quickly changing the longitudinal position of the rolls relative to the pipe to allow it to handle heavier or lighter pipe. The forces applied to the pipe will be between the upper central dual roll stand S-3 and the two lower dual roll stands S-2 and S-4. The outer single rolls which engage the top of the pipe as it moves through the apparatus also coact with the rolls of the lower stands to apply desired forces. In addition, the roll of stand S-1 assists in reducing wobble of the pipe at the entrance end. The overall apparatus is relatively simple in its operation but is very rugged and capable of handling relatively large size pipe.

ROLL CONFIGURATION

The rolls R, which are shown mounted within the various roll stands heretofore described, have a single radius which forms their concave surface. The feed rate per revolution of the pipe through the rolls is primarily determined by the skew angle of the roll relative to the pipe axis. In most cases, the pipe will straighten on any feed rate per revolution from one diameter of the pipe to four diameters of the pipe, provided that the rolls have a proper radius related to the selected skew angle.

The feed rate per minute of the pipe, which is the actual travel or feed per minute of the pipe through assembly A, is controlled not only by the feed rate per revolution but also by the number of such revolutions. The principal limiting factor on this feed per minute of throughput is the centrifugal force and wobble or whipping of the pipe end due to the rotation of the crooked pipe which is still outside of the entrance end of the straightening assembly A. Since smaller pipe diameter is limber and more prone to whip, the rotating speed of the smaller crooked pipe is severely limited. Thus, if the feed rate per minute can be doubled by changing the feed rate per revolution through selection of skew angle and radius of the roll, the throughput will be doubled without having to change the rotating speed.

In connection with the rolls R, it should be noted that by using the dual rolls in the apparatus, the load is divided between such dual rolls, with a result that shorter rolls can be employed to carry the same load as a single longer roll. Shortening of the rolls reduces the end diameter of a roll relative to its root diameter, thereby reducing the depth of the profile radius which results in reducing any scrubbing action between the roll surface and the pipe and increases roll life.

Figure 11:
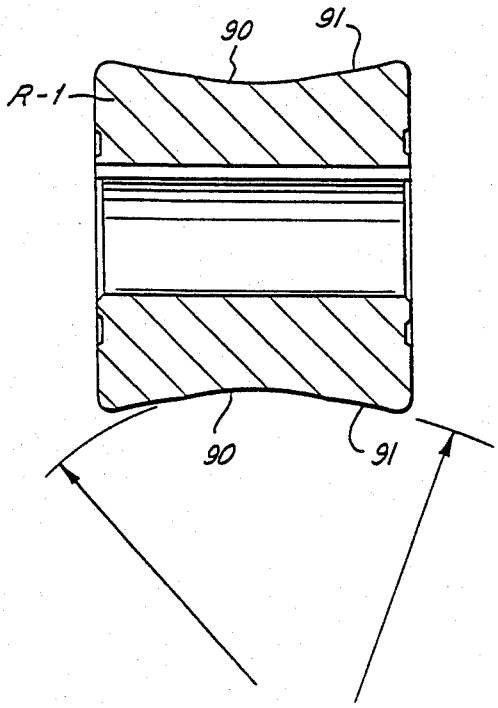
FIG. 11 is a cross-sectional view of the roll which is formed with a double radius for controlling the feed rate per revolution of the pipe.
Figure 12:
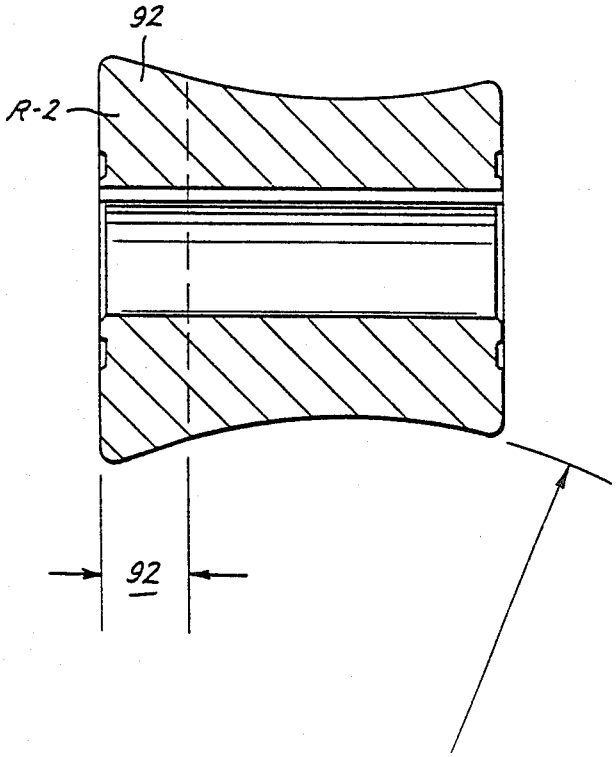
FIG. 12 is a view of a modified form of roll having one end increased in size to assist in handling sharp bends in said pipe.

In FIGS. 11 and 12, modified forms of rolls R-1 and R-2 are illustrated. The roll R-1 has a dual radius, the smaller one being designated 90 and the larger one being designated 91. By machining this dual radius in the surface of the roll and using each respective radius at its own skew angle, a combination of two different feed rates may be achieved on the same set of rolls. For example, a one pipe diameter feedthrough per pipe revolution on the larger radius may be accomplished; however, where the smaller radius 90 is employed, twice that feed rate or two pipe diameters of feed rate per pipe revolution can be accomplished. This capability of two different feed rates, coupled with the individual motors which drive the roll at selected speeds, gives the apparatus exceptional versatility in handling various pipe sizes.

In FIG. 12, the roll R-2 has only a single radius in its concave surface but the leading end section of the roll, which is the area between the lines marked 92, forms somewhat of an extension of the concave surface, as compared to the roll R shown in FIG. 3. The roll R-2 is mounted so that its extended end 92 is the leading end of the roll and such extension makes the roll effective in handling extremely sharp bends in the pipe. On the relatively short rolls R, a sharp bend might tend to ride over the roll and by extending its length in the manner shown in FIG. 12, this disadvantage is eliminated.

What is claimed is:

1. An apparatus for straightening elements including:

a main frame structure, at least a pair of lower roll stands within the frame structure each of which includes a roll for supporting the element to be straightened as said element moves through the apparatus in a horizontal direction, means mounting each lower roll stand for independent individual movement in a horizontal direction and parallel to the axis of the element being straightened, power actuating means operatively connected to each lower roll stand to selectively move the same in said horizontal direction, a central upper roll stand within the frame structure having a roll for engaging the element being straightened and located between the lower roll stands, means mounting said central upper roll stand for vertical movement whereby the roll thereof may engage the element being straightened to exert a downward pressure on that area of said element which is located between said lower roll stands, operation of the power actuating means for each lower roll stand moving such lower roll stand relative to the central upper roll stand in a horizontal direction to change the effective lever arm formed between the roll of said lower roll stand and the roll of the central upper stand, and thereby control the bending force being applied to the element by said lower roll and the roll of the central upper stand, a pair of upper outer roll stands within the frame structure, one on each side of the upper central roll stand and each upper outer roll stand having a roll for engaging the element being straightened, said upper outer roll stands being located outwardly of the lower roll stands longitudinally of the element being straightened, means mounting each outer roll stand for movement in a vertical direction and for independent individual movement in a horizontal direction relative to the element being straightened, whereby the roll of each outer stand engages the element being straightened in predetermined areas spaced outwardly from the upper central roll stand, and also spaced outwardly from the nearest lower roll stand, power actuating means operatively connected to each upper outer roll stand to selectively move the same in said horizontal direction, operation of the power actuating means for each upper outer roll moving such upper outer roll stand relative to the nearest lower roll stand in said horizontal direction to change the effective lever arm formed between the roll of said upper outer roll stand and the roll of said nearest lower roll stand and thereby control the bending force being applied to the element by said upper outer roll and the roll of said nearest lower roll stand, means mounting each roll in each stand to individually and selectively dispose each roll in a skewed and engaged position relative to the element being straightened, means rotating at least some of the rolls of the roll stands whereby said rolls impart movement to the element being straightened to move said element through the apparatus while applying predetermined leverage forces in preselected areas to said element to thereby accomplish the straightening operation, and individual control means operatively connected to each roll stand forming part of the associated power actuating means for each roll stand to control actuation of the associated roll of each such stand, said control means and associated power actuating means for each roll stand being operable independently of such means for other roll stands while an element is being straightened and moving through the apparatus in a horizontal direction whereby the operation of the apparatus is continuous while movements of selected roll stands with respect to each other and relative to the element being straightened are occurring.

2. An apparatus for straightening elements as set forth in claim 1, wherein the means mounting each roll in each stand to control the skewed position of said roll relative to the element being straightened is a power-operated means, and the means rotating each roll is also a power-operated means connected to each roll.

3. An apparatus for straightening elements as set forth in claim 1, wherein each lower roll stand includes dual rolls, and a power-operated motor connected to each roll of each dual roll unit, whereby each roll is independently controlled in its rotation.

4. An apparatus for straightening elements as set forth in claim 1, wherein each lower roll stand includes dual rolls for engaging the element being straightened, the central upper roll stand also having a dual roll mounted therein for engaging the element being straightened, and each of the pair of upper outer roll stands including only a single roll which is adapted to engage the upper surface of the element.

5. An apparatus for straightening elements as set forth in claim 1, together with a stabilizer assembly disposed at the entrance end of the main frame structure and having supporting rolls for engagement with the element being straightened, and means mounting said stabilizer assembly for movement relative to the entrance end of said structure, whereby the position of said stabilizer assembly with respect to the roll stands within the main frame structure may be varied in accordance with the size cross-sectional shape or bend of the element being straightened.

6. An apparatus for straightening pipe including, a main frame structure, a central upper roll stand within the frame structure and having dual rolls for engaging the upper structure of the pipe being straightened, means mounting said central upper roll stand for vertical movement with respect to the pipe to thereby control the force applied to the pipe by the dual rolls of said stand, means mounting the dual rolls of said central roll stand to dispose said rolls at an angle with respect to the longitudinal axis of the pipe being straightened, a pair of lower roll stands within the frame structure, with said stands being located one on each side in a horizontal direction from the central upper roll stand, means mounting each lower roll stand for independent movement in a horizontal direction parallel to the axis of the pipe, each lower roll stand having dual rolls mounted thereon for supporting and applying upward forces to the pipe to be straightened as the pipe moves through the apparatus, means mounting the dual rolls of each lower roll stand to dispose said rolls at an angle with respect to the longitudinal axis of the pipe being straightened, a pair of upper outer roll stands within the frame structure, one on each side of the central upper roll stand and also located outwardly of the lower roll stands in a horizontal direction, each stand having a roll for engaging the pipe to be straightened, means mounting each of said upper outer roll stands for independent movement in a horizontal direction along the pipe being straightened to permit the position of the roll of each such outer roll stand to be adjusted in said horizontal direction relative to the rolls of the lower and the central roll stands, means also mounting each of said upper outer roll stands for independent movement in a vertical direction relative to the pipe being straightened to apply the desired downward force to said pipe, means mounting the roll of each upper outer roll stand to dispose said roll at a preselected angle with respect to the longitudinal axis of the pipe being straightened, means independently rotating at least some of the rolls of the roll stands, whereby said rotating rolls impart movement to the pipe being straightened to move the pipe through the apparatus while all rolls apply predetermined forces in preselected areas to the pipe to thereby accomplish the straightening operation, independent power actuating means operatively connected to each of the roll stands to move an associated roll stand in its respective direction of movement independently of the other roll stands, and individual control means operatively connected to each roll stand forming part of the associated power actuating means for each such roll stand and controlling actuation of the associated roll of such stand, said control means and power actuating means for each roll stand being operable independently of such means for other roll stands while the pipe is being straightened and moving through the apparatus in a horizontal direction whereby predetermined movements of selected roll stands with respect to each other and relative to the pipe being straightened are occurring during a continuous operation of the apparatus.

7. An apparatus for straightening pipe as set forth in claim 6, together with a stabilizer assembly mounted at the entrance end of the main frame structure and including supporting rolls for engaging the pipe being straightened, a guide bar unit at the exit end of the main frame structure and including a supporting roll for guiding the straightened pipe from the apparatus, and a lift assembly located in advance of the stabilizer assembly for lifting a pipe to the proper elevation for entrance through the stabilizer assembly to the main frame structure wherein said pipe is engaged by the rolls of the roll stands.

8. An apparatus for straightening pipe as set forth in claim 6, wherein the means mounting said central upper roll stand and its dual rolls include supporting means for each roll connected to the main frame structure, a support plate for each roll attached to said supporting means, a swivel base rotatable upon each support plate and having spaced arms projecting therefrom, a roll mounted between the projecting arms of each swivel base and adapted to engage the pipe surface, a hydraulically actuated means connected with each roll for rotating said roll, and hydraulically actuated means connected with each swivel base for rotating the base to change the angle of the roll with respect to the pipe being straightened.

9. An apparatus as set forth in claim 8, wherein the supporting means for the upper roll stand is a piston and cylinder, means mounting said cylinder on the main frame structure, and means connecting each piston to the respective support plate for each roll of the upper roll stand.

10. An apparatus for straightening pipe as set forth in claim 6, wherein the means mounting said central upper roll stand and its dual rolls include a cylinder mounted on the main frame structure and having a piston movable therein, the lower portion of the piston projecting downwardly from the cylinder, a support plate for each roll attached to the projecting lower end of the piston, a swivel base for each roll rotatable upon each support plate and having spaced arms projecting therefrom, a roll mounted between the projecting arms of each swivel base and adapted to engage the pipe surface, an individual hydraulically actuated means connected with each roll for rotating said roll, and hydraulically actuated means connected with each swivel base for rotating the base to change the angle of each roll with respect to the pipe being straightened.

11. An apparatus for straightening elements including a main frame structure, at least a pair of lower roll stands within the frame structure, each lower roll stand having a roll for supporting the element to be straightened as said element moves through the apparatus in a horizontal direction, means mounting each lower roll stand for independent individual movement in a horizontal direction and parallel to the axis of the element being straightened, actuating means operatively connected to each lower roll stand to selectively move the same in said horizontal direction, a central upper roll stand within the frame structure having a roll for engaging the element being straightened and located between the lower roll stands, means mounting said central upper roll stand for vertical movement only whereby the roll thereof may engage the element being straightened to exert a downward pressure on that area of said element which is located between said lower roll stands, operation of the actuating means for each lower roll stand moving such lower roll stand relative to the central upper roll stand in a horizontal direction to change the effective lever arm formed between the roll of said lower roll stand and the roll of the central upper stand, and thereby control the bending force being applied to the element by said lower roll and the roll of the central upper stand, a pair of upper outer roll stands within the frame structure, one on each side of the upper central roll stand and each outer roll stand having a roll for engaging the element being straightened, means mounting each outer roll stand for movement in a vertical direction and for independent individual movement in a horizontal direction relative to the element being straightened, whereby the roll of each outer stand engages the element being straightened in predetermined area spaced outwardly from the upper central roll stand and from the closest lower roll stand, actuating means operatively connected to each upper outer roll stand to selectively move the same in said horizontal direction, operation of the actuating means for each upper outer roll stand moving such upper outer roll stand relative to the nearest lower roll stand in said horizontal direction to change the effective lever arm formed between the roll of said upper outer roll stand and the roll of said nearest lower roll stand and thereby control the bending force being applied to the element by said upper outer roll and the roll of said nearest lower roll stand, means mounting each roll in each stand to individually and selectively dispose each roll in a skewed and engaged position relative to the element being straightened, means rotating at least some of the rolls of the roll stands whereby said rolls impart movement to the element being straightened to move said element through the apparatus while applying predetermined leverage forces in preselected areas to said element to thereby accomplish the straightening operation, a hydraulic control system forming part of the actuating means for each roll stand and controlling actuation of the roll of such stand, said system and actuating means being operable while an element is being straightened in the apparatus, and an individual control for each hydraulic system to control the same, whereby the operation of the apparatus need not be stopped while movements of the roll stands with respect to each other and relative to the element are occurring.

12. An apparatus for straightening an elongated element of a circular cross section in a continuous operation as the element is moving through the apparatus in a horizontal direction, said apparatus comprising:

a main frame structure, at least a pair of horizontally spaced lower roll stands within the frame structure, each roll stand having a roll for supporting the element as the element moves through the apparatus in a horizontal direction, means mounting each lower roll stand for independent individual movement in a horizontal direction parallel to the longitudinal axis of the element, a central upper roll stand within the frame structure located between the pair of lower roll stands and having a roll for engaging the element, means mounting said central upper roll stand for vertical movement whereby the roll thereof may engage the element to exert a downward pressure on the area of the element located between the lower roll stands, a pair of upper outer roll stands within the frame structure on opposite sides of the center upper roll stand and horizontally outwardly of the lower roll stands, each upper roll stand having a roll for engaging the element to be straightened, means mounting each upper outer roll stand for independent movement in a horizontal direction parallel to the longitudinal axis of said element, independent power actuating means operatively connected to each of the roll stands to move an associated roll stand in its respective direction of movement independently of the other roll stands, the operation of the power actuating means for each lower roll stand moving such lower roll stand in a horizontal direction relative to the central upper roll stand to change the effective lever arm formed between the associated rolls of said lower roll stand and said central upper stand to control the bending force being applied to the element by said associated rolls, the operation of the power actuating means for each upper outer roll stand moving such upper outer roll stand in a horizontal direction relative to the nearest lower roll stand to change the effective lever arm formed between the associated rolls of said upper outer roll stand and said nearest lower roll stand to control the bending force being applied to the element by such associated rolls, means rotating at least some of the rolls of the roll stands whereby said rolls impart movement to the element to move the element through the apparatus, and individual control means operatively connected to each roll stand forming part of the associated power actuating means for each such roll stand to control actuation of the associated roll of each such stand, said control means and associated power actuating means for each roll stand being operable independently of such means for other roll stands while an element is being straightened and moving through the apparatus in a horizontal direction whereby the operation of the apparatus is continuous while movements of selected roll stands with respect to each other and relative to the element being straightened are occurring.

13. An apparatus for straightening an elongated element of a circular cross section in a continuous operation as the element is moving through the apparatus in a horizontal direction, said apparatus comprising:

a main frame structure, at least a pair of horizontally spaced inner roll stands within the frame structure on one side of the element, each inner roll stand having a roll for contacting the element as the element moves through the apparatus in a horizontal direction, means mounting each inner roll stand on said one side of the element for independent individual movement in a horizontal direction parallel to the longitudinal axis of the element, a central roll stand within the frame structure located on the opposed side of the element and positioned longitudinally along the element between the pair of inner roll stands on said one side of the element, said central roll stand having a roll for engaging the element, a pair of outer roll stands within the frame structure on the opposed side of the element and on opposite sides of the center roll stand and horizontally outwardly of said inner roll stands, each outer roll stand having a roll for engaging the element to be straightened, means mounting each outer roll stand for independent movement in a horizontal direction parallel to the longitudinal axis of said element, means mounting the roll stands on one of said sides of the element for individual vertical movement whereby the rolls thereof may engage the element to exert a pressure tranversely on the element, independent actuating means operatively connected to the mounting means for each of the roll stands to move an associated roll stand in its respective direction of movement independently of the other roll stands, the operation of the actuating means for each inner roll stand moving such inner roll stand in a horizontal direction relative to the central roll stand to change the effective lever arm formed between the associated rolls of such inner roll stand and said central roll stand to control the bending force being applied to the element by said associated rolls, the operation of the actuating means for each outer roll stand moving such outer roll stand in a horizontal direction relative to the nearest inner roll stand to change the effective lever arm formed between the associated rolls of such outer roll stand and said nearest inner roll stand to control the bending force being applied to the element by such associated rolls, means rotating at least some of the rolls of the roll stands whereby said rolls impart movement to the element to move the element through the apparatus, and individual control means operatively connected to each roll stand forming part of the associated actuating means for each such roll stand to control actuation of the associated roll of each such stand, said control means and associated actuating means for each roll stand being operable independently of such means for other roll stands while an element is being straightened and moving through the apparatus in a horizontal direction whereby the operation of the apparatus is continuous while movements of selected roll stands with respect to each other and relative to the element being straightened are occurring.

* * * * *